US007601046B2

(12) United States Patent
Chang

(10) Patent No.: US 7,601,046 B2
(45) Date of Patent: Oct. 13, 2009

(54) LAUNCHING DEVICE FOR TOY ROCKET

(76) Inventor: Ping-Sung Chang, No. 20-6, Letian Lane, Nantun District, Taichung City (TW)

( * ) Notice: Subject to any disclaimer, the term of this patent is extended or adjusted under 35 U.S.C. 154(b) by 168 days.

(21) Appl. No.: 11/907,971

(22) Filed: Oct. 19, 2007

(65) Prior Publication Data

US 2009/0104839 A1 Apr. 23, 2009

(51) Int. Cl.
*A63H 33/20* (2006.01)
*A63H 27/00* (2006.01)

(52) U.S. Cl. ..... 446/212; 446/52; 124/26

(58) Field of Classification Search ..... 446/34, 446/36, 49, 51, 52, 129, 212, 429, 435, 454, 446/456, 211, 400, 156, 57, 231; 124/26, 124/37, 57, 64, 73, 56, 63, 69
See application file for complete search history.

(56) References Cited

U.S. PATENT DOCUMENTS 3,091,052 A * 5/1963 Ryan ..... 446/212
3,101,569 A * 8/1963 Giardina ..... 446/230
3,121,292 A * 2/1964 Butler et al. ..... 446/212
3,177,612 A * 4/1965 Giossi ..... 446/64
4,897,065 A * 1/1990 Fertig et al. ..... 446/63
5,188,557 A * 2/1993 Brown ..... 446/212
5,951,354 A * 9/1999 Johnson ..... 446/52
6,321,737 B1 * 11/2001 Johnson et al. ..... 124/73
6,752,682 B1 * 6/2004 Ferrell ..... 446/230

* cited by examiner

*Primary Examiner*—Nini Legesse

(57) ABSTRACT

A toy rocket launching device includes a stand and a positioning unit is pivotably connected to the stand. A control unit includes a control member which has a first end connected to an injection nozzle of the rocket and a second end of the control member extends through a positioning unit and is secured by a threaded sleeve. An valve is inserted into the first end of the control member and a cap is mounted on the first end of the control member. An activation member is located in the positioning unit and multiple balance cables are connected between the activation member and the cap. An end of an activation cable is connected to a center of the activation member so that when the activation cable is pulled, the cap is simultaneously pulled to activate the injection nozzle to lunch the toy rocket.

7 Claims, 10 Drawing Sheets

LAUNCHING DEVICE FOR TOY ROCKET

FIELD OF THE INVENTION

The present invention relates to a launching device for launching a toy rocket operated by pressure and the activation member of the launching device steadily launches the toy rocket.

BACKGROUND OF THE INVENTION

A conventional launching device "B" for launching toy rocket from a stand "A" is shown in FIG. 9 and generally includes a control member "B2" which has one end secured on the stand "A" by a threaded sleeve "B1" and the other end of the control member "B2" is connected with the injection nozzle on the rocket "C". A plate "B3" has one end connected to the control member "B2" and includes an extension "B31" to which one end of a cable "A1" is connected. The rocket "C" is made by a bottle in which a proper pressurized air is filled. When the cable "A1" is pulled, the launching device "B" is activated and the rocket "C" is launched from the stand "A". However, the cable "A1" is connected the extension "B31" which is offset from the center of the control member "B2" and the rocket "C" so that the rocket "C" tends to tilt and might hurt people around the launching site. Besides, the rocket "C" has a weight which makes the rocket "C" to fall down to the ground by gravity. Once the rocket "C" is not launched along the expected path, the rocket "C" with the weight could injure people.

The present invention intends to provide a launching device for toy rocket and includes an activation member which is connected with balance cables and the activation cable so that the activation member activate the control member and the injection nozzle without tilting the rocket.

SUMMARY OF THE INVENTION

The present invention relates to a toy rocket launching device that comprises a stand with a U-shaped frame pivotably connected thereto and a transverse plate is connected between two legs of the U-shaped frame. A control member has a first end connected to an injection nozzle of a toy rocket and a second end of the control member extends through a transverse portion of the U-shaped frame and is secured by a threaded sleeve. A valve is inserted into the first end of the control member and engaged with the injection nozzle of the toy rocket. A cap is mounted on the first end of the control member. An activation member is located between the transverse plate and the transverse portion of the U-shaped frame. Multiple balance cables are connected between the activation member and the cap. An end of an activation cable extends through the transverse plate and is connected to a center of the activation member, the other end of the activation cable is connected with a trigger device 40.

The primary object of the present invention is to provide a toy rocket launching device which launches the toy rocket without tilting the toy rocket.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
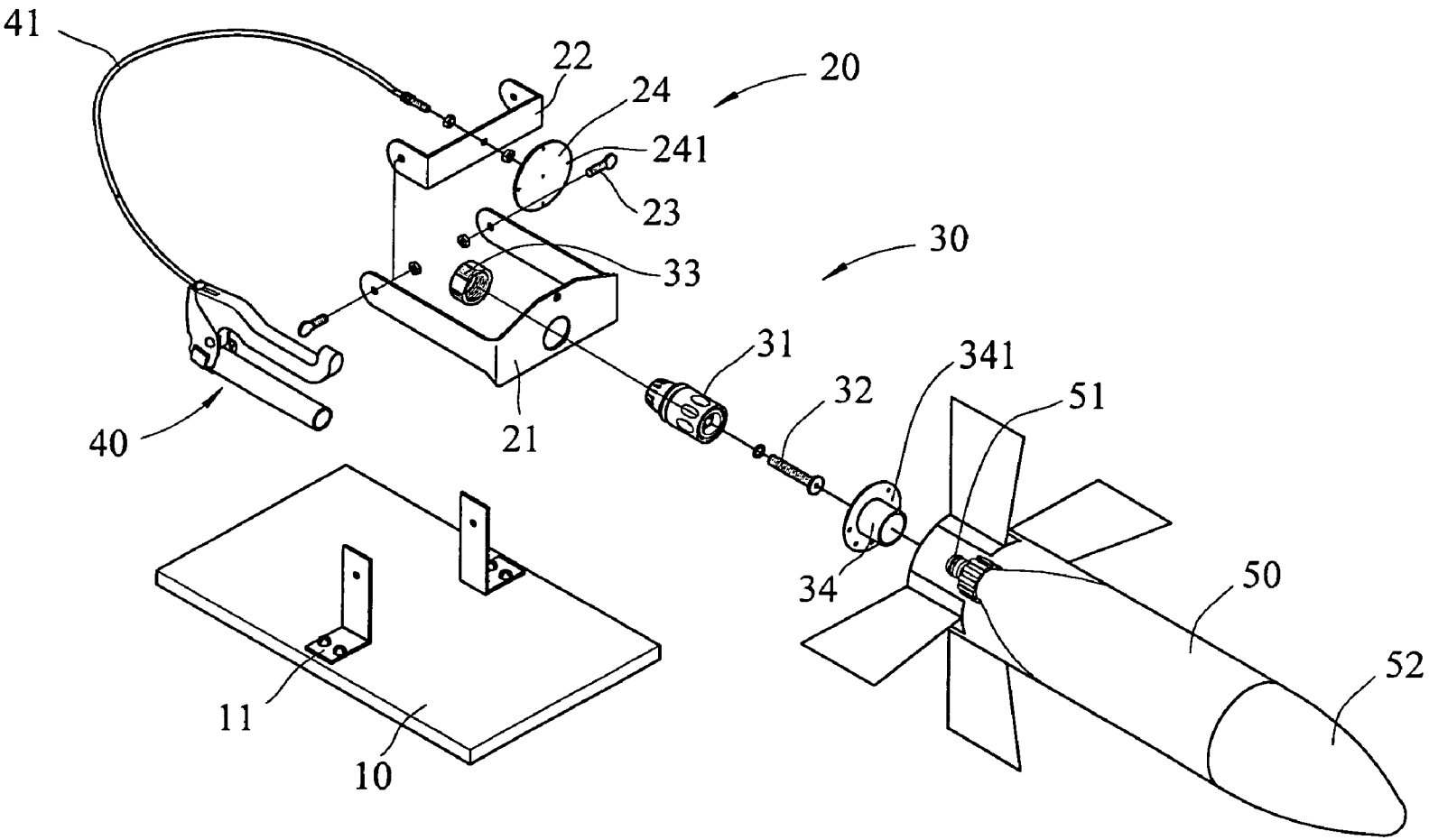
FIG. 1 is an exploded view to show the toy rocket and the launching device of the present invention.
Figure 2:
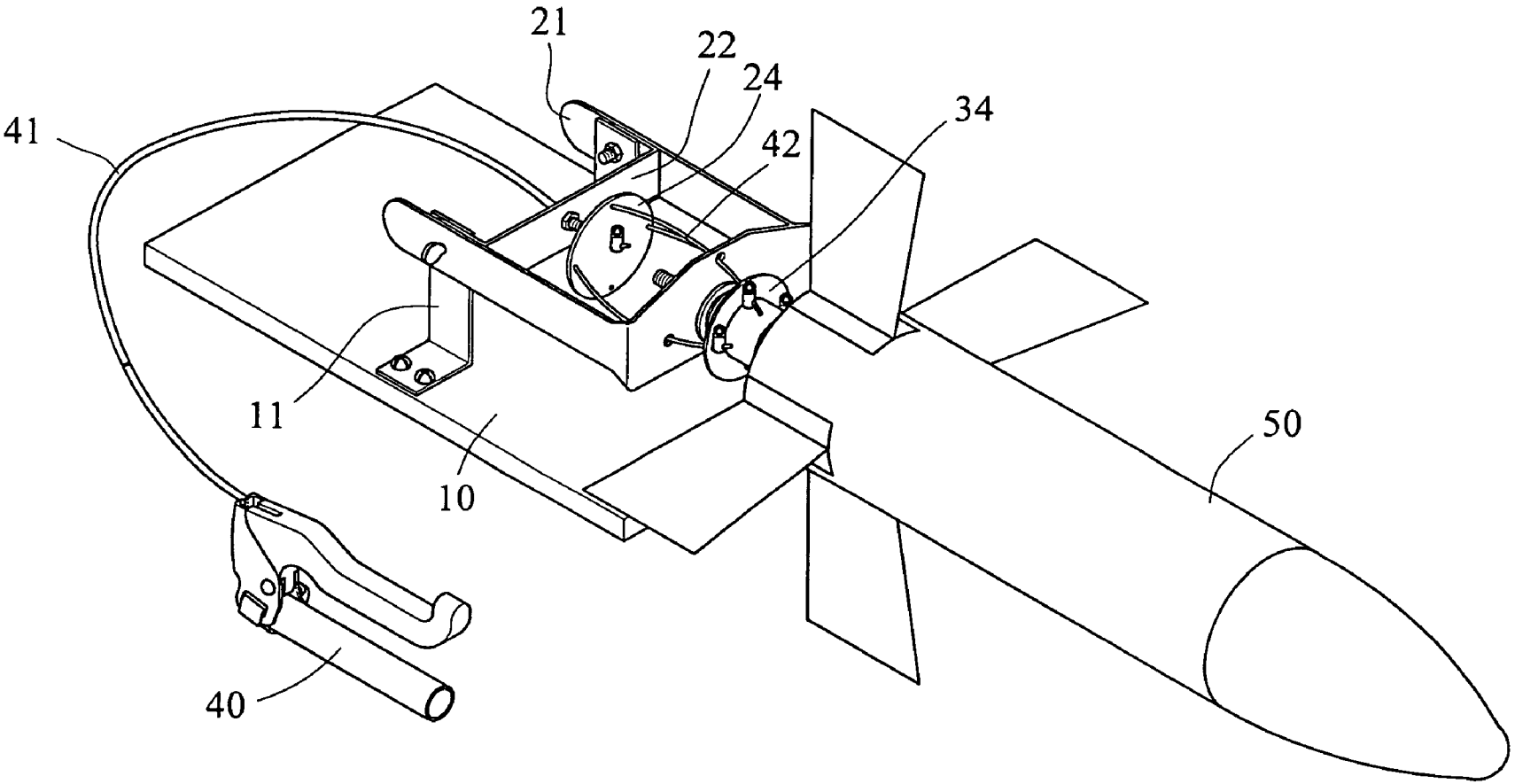
FIG. 2 is a perspective view to show that the toy rocket is connected to the positioning unit on the stand of the launching device of the present invention.

Referring to FIGS. 1 and 2, the toy rocket launching device of the present invention comprises a stand 10 which is a board and two lugs 11 are connected on a top of the stand 10. A positioning unit 20 includes a U-shaped frame 21 which includes two legs and a transverse portion connected between the two legs, the two legs are pivotably connected to the two lugs 11 on the stand 10. A transverse plate 22 is connected between two legs of the U-shaped frame 21 by bolts 23.

A control unit 30 includes a control member 31 which has a first end connected to an injection nozzle 51 of a rocket 50 and a second end of the control member 31 extends through the transverse portion of the U-shaped frame 21 and is secured by a threaded sleeve 33. A valve 32 is inserted into the first end of the control member 30 and a cap 34 is mounted on the first end of the control member 31. The valve 32 is engaged with the injection nozzle 51 so that pressurized air can be supplied into the toy rocket 50 via the injection nozzle 51. The cap 34 includes a flange through which four holes 341 are defined therethrough.

An activation member 24 which is a circular disk and includes four holes as well. The activation member 24 is located between the transverse plate 22 and the transverse portion of the U-shaped frame 21. Four balance cables 42 are connected the holes 241, 341 in the activation member 24 and the cap 34 so as to connect the activation member 24 and the cap 34 together. An end of an activation cable 41 extends through the transverse plate 22 and connected to a center of the activation member 24. The control member 31 includes an inner tube 310 and a plurality of pivotable members 311 (only one is shown) are engaged in the inner tube 310 so that the injection nozzle 51 can be temporarily connected with the control member 31. The pivotable members 311 are pushed by the cap 34. The other end of the activation cable 41 is connected with a trigger device 40.

Figure 7:
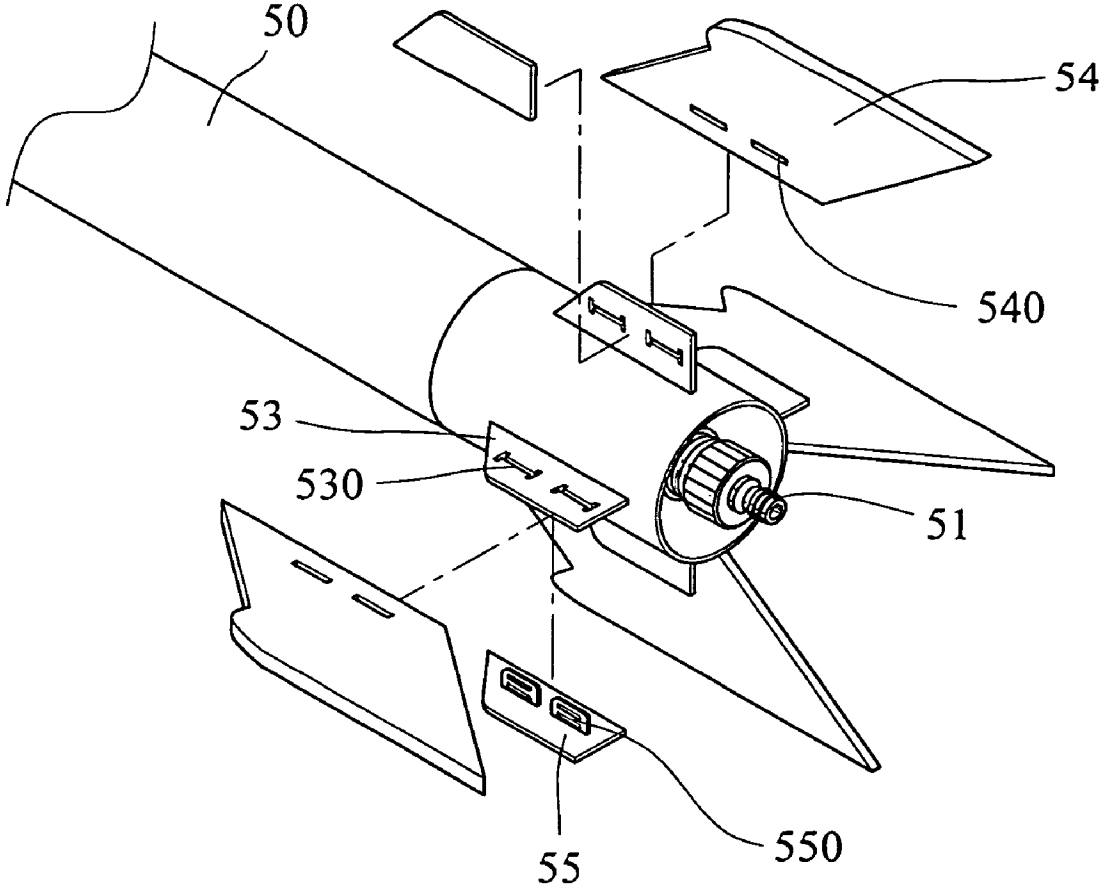
FIG. 7 is an exploded view to show the tail wings and the body of the toy rocket of the present invention.
Figure 8:
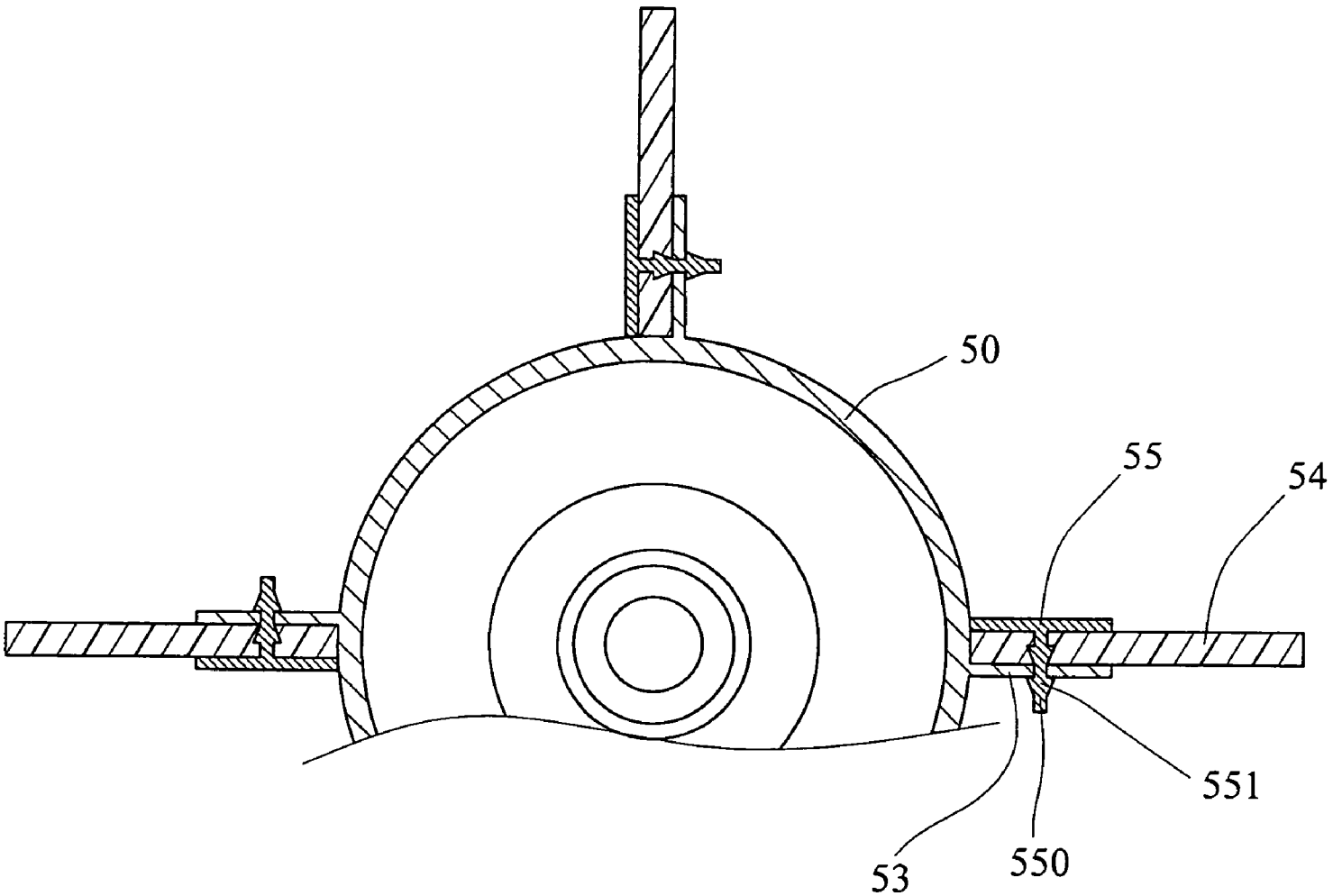
FIG. 8 shows a cross sectional view of the connection of the tail wings and the positioning plates on the toy rocket.
Figure 9:
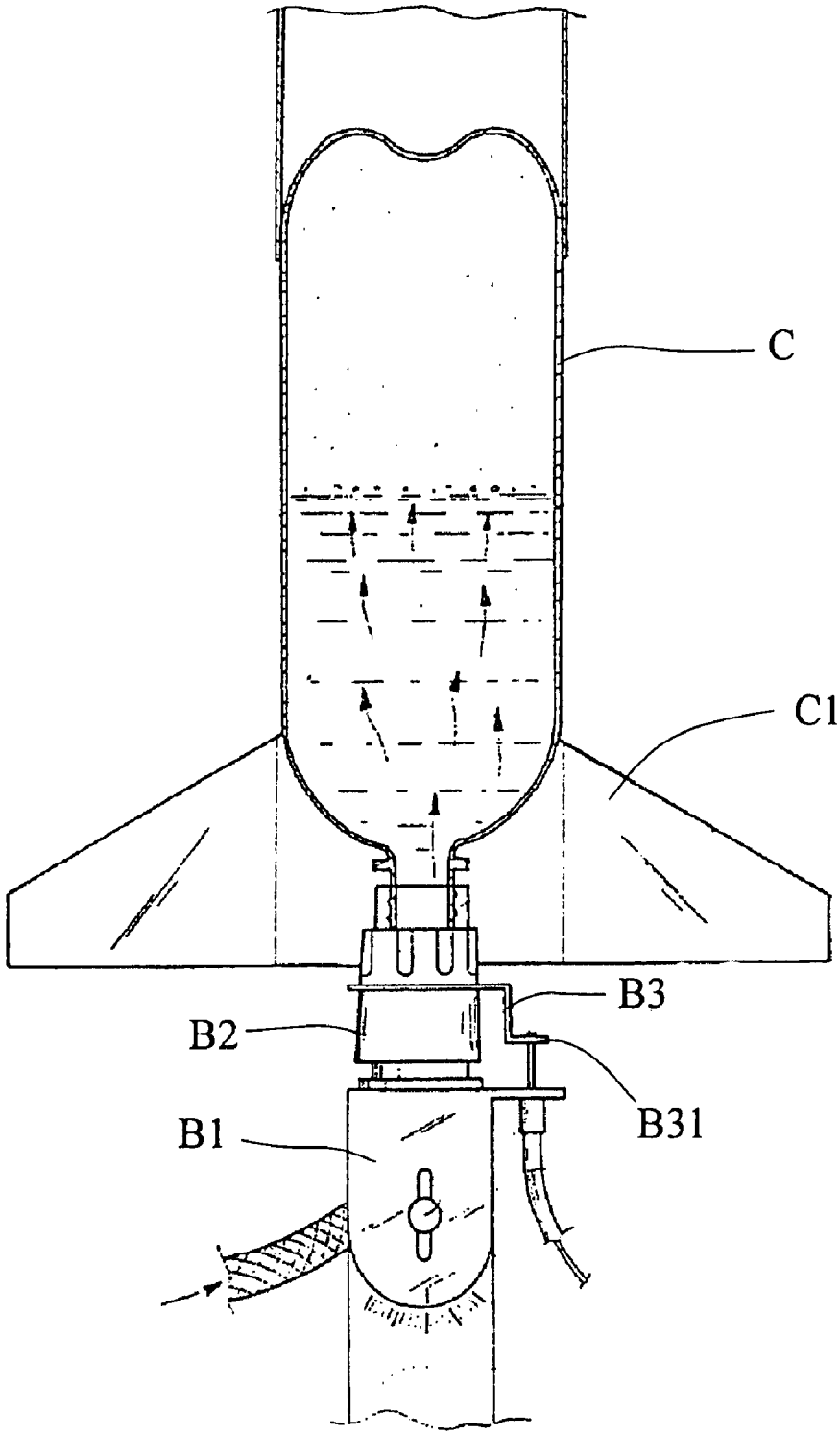
FIG. 9 PRIOR ART
FIG. 9 shows a conventional launching device and a toy rocket.

Referring to FIGS. 7 and 8, the toy rocket 50 includes four positioning plates 53 extending perpendicularly from an outer periphery of a tail end thereof and each positioning plate 53 has two first elongate slots 530. Four tail wings 54 each have two second elongate slots 540 which are located in alignment with the first elongate slots 530. Four securing members 55 each have two securing plates 550 extending from one surface thereof and the securing plates 550 extend through the first and second elongate slots 530, 540 to connect the trail wings 54 to the positioning plates 53. Each of the securing plates 550 includes tapered hooks 551 which extend through the first and second elongate slots 530, 540 to prevent the tail wings 54 from disengaging from the positioning plates 53.

Figure 4:
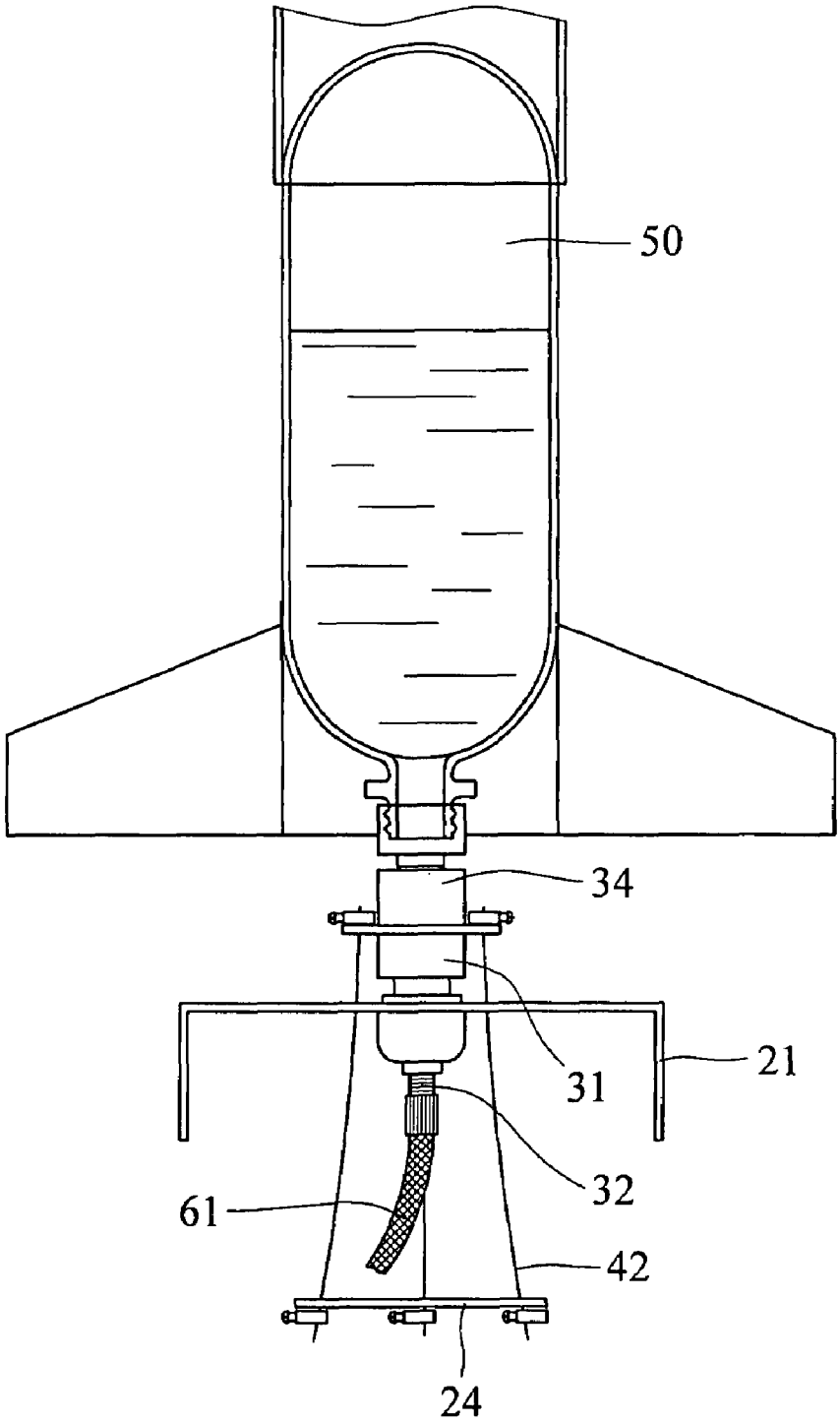
FIG. 4 shows the toy rocket is filled with pressurized air.
Figure 5A:
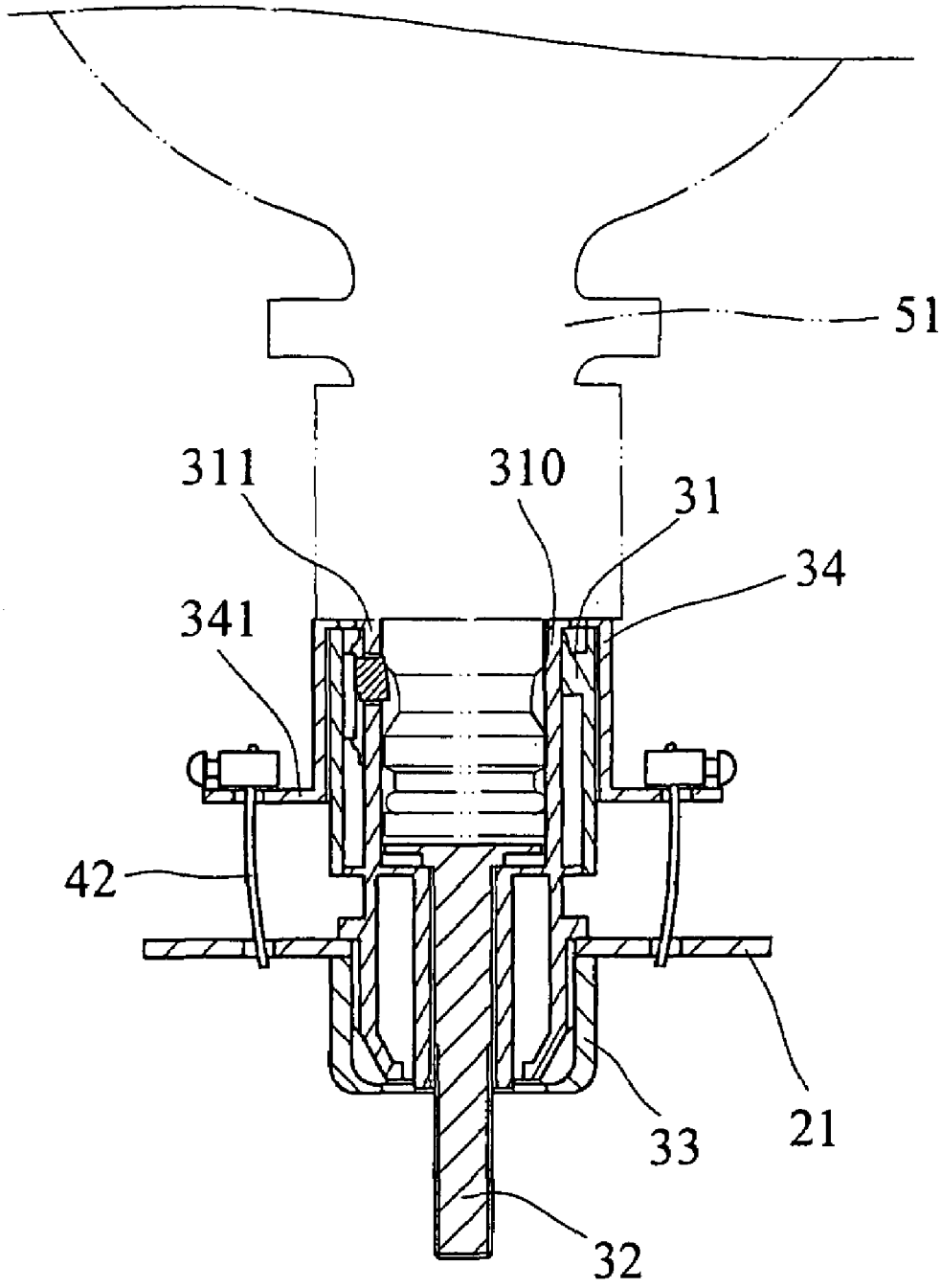
FIG. 5A shows that the activation member is pulled downward.
Figure 5B:
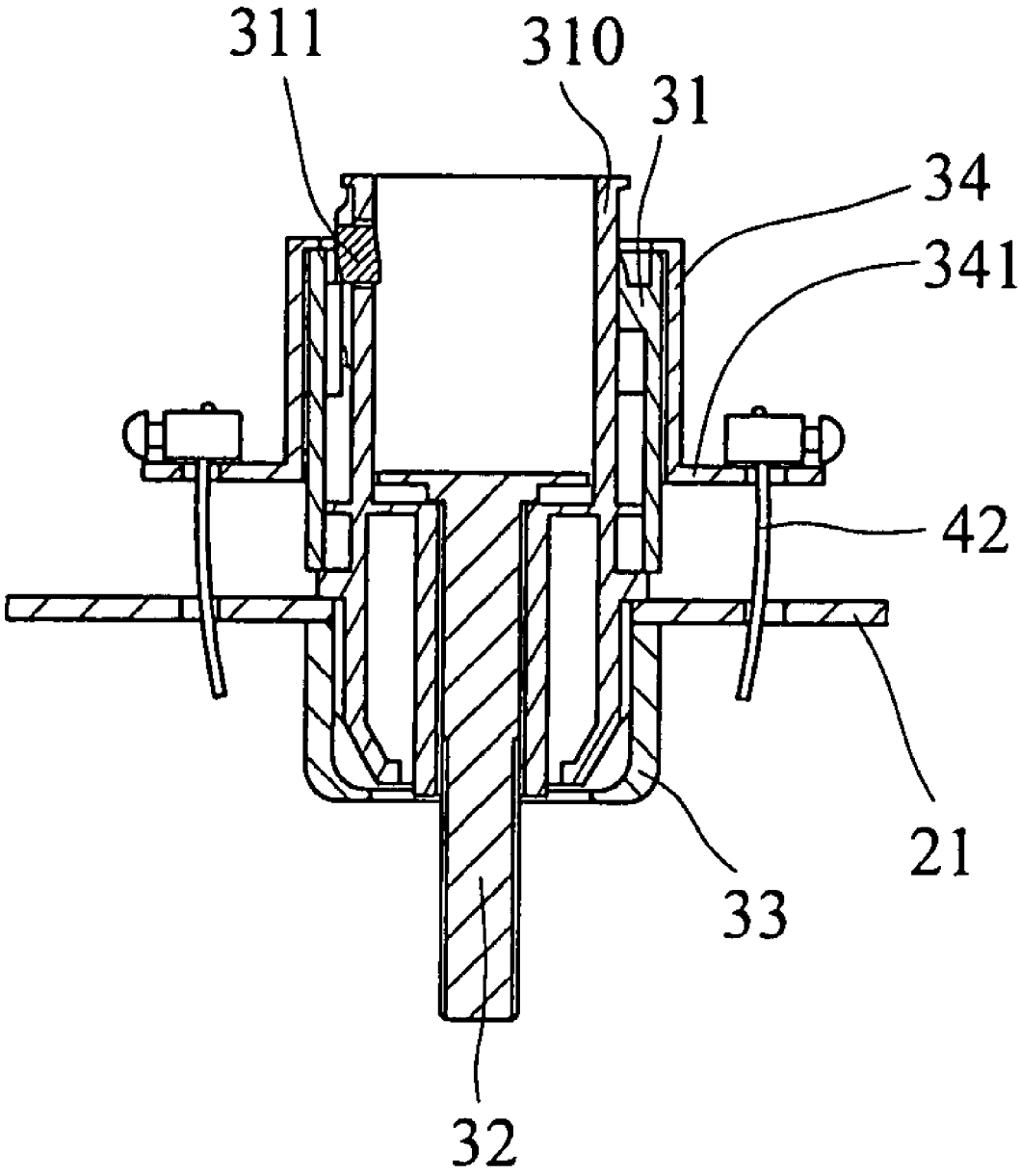
FIG. 5B shows that the valve is lowered.
Figure 6:
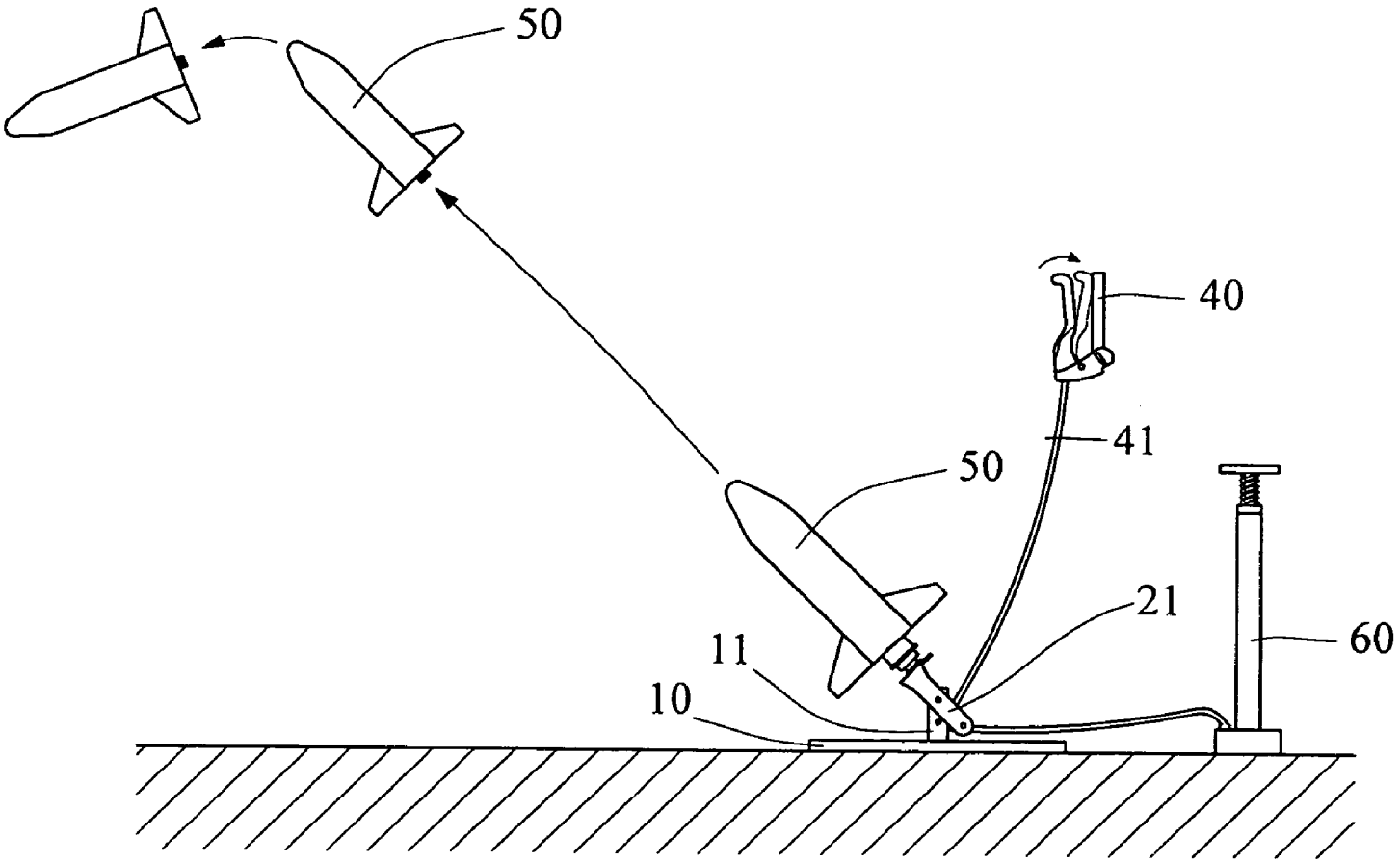
FIG. 6 shows that the toy rocket is launched.

As shown in FIG. 4, a pipe 61 is connected to the valve 32 and supplies air into the interior of the body of the toy rocket 50 in which a proper amount of water is received. After a proper pressure is reached, the U-shaped frame 21 is pivoted to set the toy rocket 50 pointing a desired angle. When operating the trigger device 40, as shown in FIGS. 5A, 5B and 6, the activation cable 41 is pulled and the activation member 24 and the cap 34 are both pulled, the pivotable members 311 are then pivoted because the cap 34 is pulled downward, the pressure in the toy rocket 50 is released from the injection nozzle 51 which is then disengaged from the control member 31 and the toy rocket 50 is launched. The four balance cables 42 are connected to the activation member 24 and the flanges of the cap 34 at even intervals so that the pulling of the activation cable 41 does not tilt the toy rocket 50.

Figure 3:
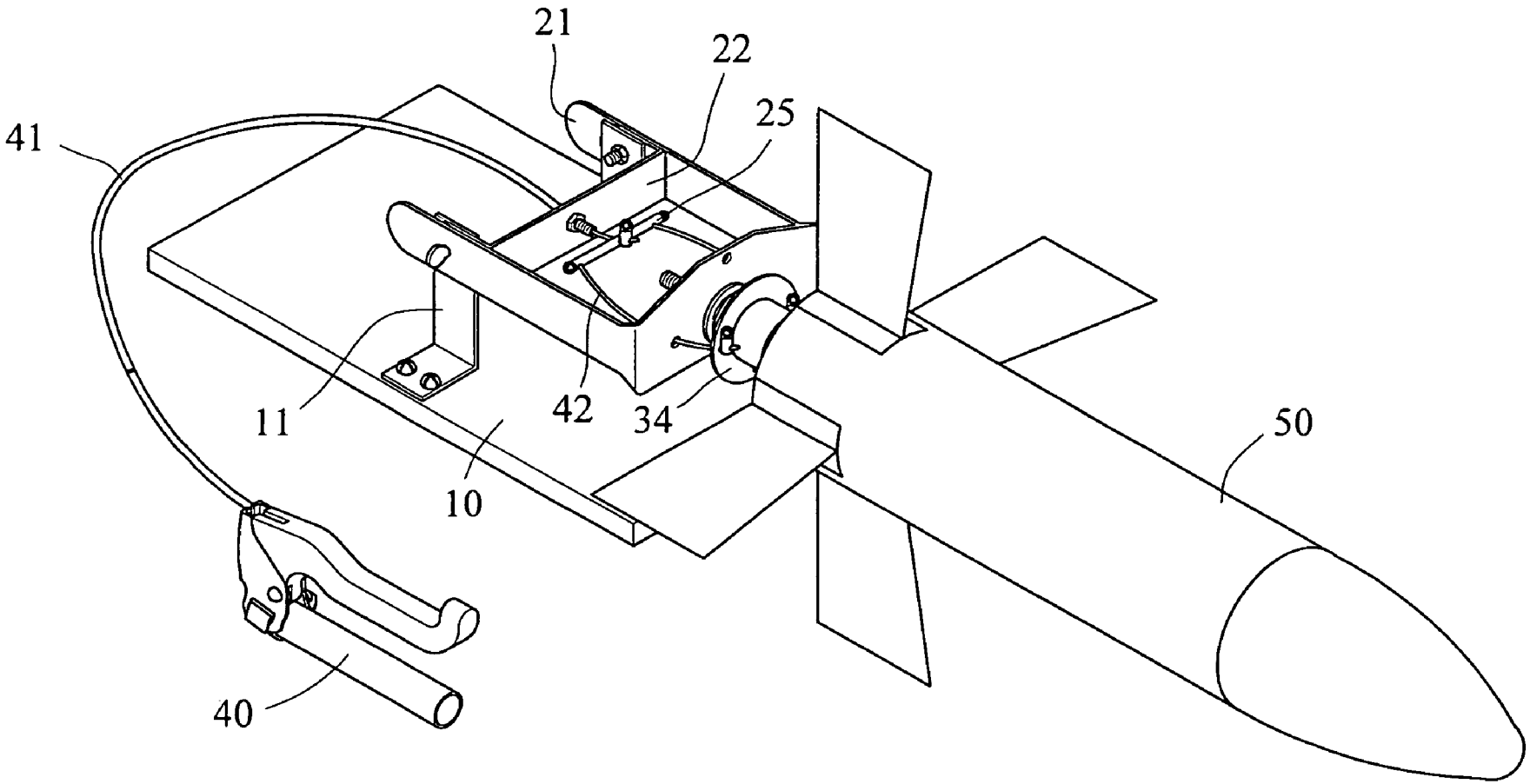
FIG. 3 is similar to FIG. 2 except for the disclosure of the other embodiment of the activation member.

As shown in FIG. 3, the activation member 24 can be an elongate member and only two balance cables 42 are needed which are connected on two ends of the activation member 24 and on diagonal line of the flange of the cap 34.

While we have shown and described the embodiment in accordance with the present invention, it should be clear to those skilled in the art that further embodiments may be made without departing from the scope of the present invention.

What is claimed is:

1. A toy rocket launching device comprising:

a stand;

a positioning unit including a U-shaped frame which is pivotably connected to the stand and a transverse plate connected between two legs of the U-shaped frame;

a control unit including a control member which has a first end connected to an injection nozzle of a toy rocket and a second end of the control member extending through a transverse portion of the U-shaped frame and secured by a threaded sleeve, a valve inserted into the first end of the control member and a cap mounted on the first end of the control member, the valve engaged with the injection nozzle of the toy rocket, and an activation member located between the transverse plate and the transverse portion of the U-shaped frame, multiple balance cables connected between the activation member and the cap, an end of an activation cable extending through the transverse plate and connected to a center of the activation member, the other end of the activation cable connected with a trigger device.

2. The device as claimed in claim 1, wherein two lugs extend from the stand and the two legs of the U-shaped frame are pivotably connected to the two lugs.

3. The device as claimed in claim 1, wherein the activation member is a circular disk.

4. The device as claimed in claim 1, wherein the activation member is an elongate member.

5. The device as claimed in claim 1, wherein the toy rocket including a soft head.

6. The device as claimed in claim 1, wherein the toy rocket includes four positioning plates extending perpendicularly from an outer periphery of a tail end thereof and each positioning plate has two first elongate slots, four tail wings each have two second elongate slots which are located in alignment with the first elongate slots, four securing members each have two securing plates extending from one surface thereof and the securing plates extend through the first and second elongate slots to connect the trail wings to the positioning plates.

7. The device as claimed in claim 6, wherein each of the securing plates includes tapered hooks which extend through the first and second elongate slots.

* * * * *